United States Patent [19]

Hurley et al.

[11] Patent Number: 4,960,345

[45] Date of Patent: Oct. 2, 1990

[54] SYSTEM FOR CONSTRUCTION OF GOLF COURSE SAND BUNKERS

[75] Inventors: Dennis Hurley, Marrero; Roy Anderson, Metainie, both of La.; Ken Gorzycki, Boerne, Tex.

[73] Assignee: Turf Drain Company of America, Inc., Marrero, La.

[21] Appl. No.: 302,589

[22] Filed: Jan. 27, 1989

[51] Int. Cl.[5] ..... E02B 11/00; E02B 13/00

[52] U.S. Cl. ..... 405/38; 405/258; 47/1.01

[58] Field of Search ..... 405/36–38, 405/43, 45, 258; 47/1 R, 48.5, 59, 62

[56] References Cited

U.S. PATENT DOCUMENTS

| | | | |
|---|---|---|---|
| 1,665,104 | 4/1928 | Martienssen | 405/38 |
| 3,625,010 | 12/1971 | Hakundy | 405/38 |
| 3,908,385 | 9/1975 | Daniel et al. | 405/38 X |
| 4,023,506 | 5/1977 | Robey | 405/43 X |
| 4,268,993 | 5/1981 | Cunningham | 405/37 X |
| 4,366,846 | 1/1983 | Curati | 405/36 X |
| 4,650,367 | 3/1987 | Dietzler | 405/43 |
| 4,679,963 | 7/1987 | Heath | 405/36 |

FOREIGN PATENT DOCUMENTS

| | | | |
|---|---|---|---|
| 2405330 | 6/1979 | France | 405/38 |
| 2560734 | 9/1985 | France | 405/38 |
| 8302790 | 8/1983 | World Int. Prop. O. | 405/38 |

*Primary Examiner*—Randolph A. Reese
*Assistant Examiner*—John Ricci
*Attorney, Agent, or Firm*—Pravel, Gambrell, Hewitt, Kimball & Krieger

[57] ABSTRACT

A system for constructing golf course traps which would include the steps of forming a cutout area in the fairway in the desired shape of the trap, the cutout area including a continuous substantially vertical sidewall and a substantially flat floor portion; and forming a plurality of channels for housing the "turf drain" composite drainage line within the channels for undertaking drainage of the traps; prior to the placement of the turf drain lines within the channels, placing a continuous sheet of material such as plastic liner along the floor of the trap and the continuous sheet forming within the plurality of channels; positioning the "turf drain" composite drainage line within the channels so that the plastic liner is positioned between the soil and the turf drainage line; and filling the trap with sufficient sand for allowing the upper most portion space of the sand within the trap to be substantially flush with the surrounding fairway, so that as water drains into the trap, the water would essentially follow the vertical wall of the trap, and would drain along the plastic liner layer, and to the turf drain lines to be drained from the trap, without the water ever making contact with the soil beneath the plastic liner layer or turf drain line.

13 Claims, 5 Drawing Sheets

SYSTEM FOR CONSTRUCTION OF GOLF COURSE SAND BUNKERS

BACKGROUND OF THE INVENTION

1. Field of the Invention

The system of the present invention relates to golf courses. More particularly, the present invention relates to an improved bunker or trap utilized on a standard golf course, which facilitates drainage of water from the trap and improves the sand distribution in the trap.

2. General Background

The bunker designs in use today present three major maintenance problems to the maintenance crews at golf courses: (1) the sand that is on the high faces (areas that are the highest part of the bunker used to make it more visible to the golfer) of the bunkers will be washed off of the face during heavy rains and have to be pushed back up following the rain, which requires a great amount of hand labor from the golf course maintenance crew. (2) The sand that is used is most preferably of a light color or white, if possible. This gives the bunker the most preferred appearance. However, over a period of time this sand tends to get dirty or contaminated from the darker and smaller particles that are in the native soil below. This means that the sand must be replaced periodically at great expense to maintain the light color of the sand. (3) They are invariably very difficult areas of the course to drain since they are normally set down lower than any other part of the surrounding course. Two of these same problems occur in the draining of coal piles, and this design would therefore have benefits in other applications. Presently a soil cement is sprayed on the ground so that the coal stays above the native soils. The drain tile in a coal pile consist of gravel drains wrapped in geo-textile fabrics. With this design, the plastic liner could be placed on the ground surface and the drain line trenches dug down into the ground. Then the waffle drain could be used to replace the gravel and fabric drain presently used at a tremendous savings.

Normally the base grade of the bunker is cut into the shape of a bowl, with the sidewalls of the bunker sloped gradually down to the low point of the bunker. This design causes the water that is moving along the interface where the sand and base grade meet to pick up speed and start to erode the sand that is resting on the base grade. In the present design, the sidewalls are cut straight down and the gradual contour that was formed by the base grade is now formed by the contouring of the sand. This allows for the water to move straight down vertically and to move laterally across the bottom of the bunker floor at a rate much slower than if it was moving down a sidewall created at an angle less than perpendicular to the floor of the bunker.

The main attempts at stopping the sand from becoming contaminated have consisted of the use of a geo-textile fabric placed as a liner in between the sand surface and the base grade composed of native soil. This presents several problems, but the most persistent is that the fibers of the geo-textile become snagged by the piece of equipment used to maintain the bunker called a "sand pro". When this happens, the "sand pro" grabs the liner, pulls it out of position and requires that the liner be replaced. There are two reasons why these fabrics consistently snag: (1) the fact that one of the characteristics of the fibers used in the fabrics is that they have a lot of elongation or stretch. This allows them to pull when grabbed by the "sand pro"; and (2) because of present design techniques, the edges are placed at the part of the bunker that have the least amount of sand, which is the top edge of the bunker. In the past, the fabrics have been used because they allowed for the movement of the water through the fabric to the drain tile placed below. The generally accepted practice attempts to drain bunkers through the use of gravel bed and a 4 inch perforated pipe. These systems fail readily; the errodability of the sand used in the bunkers allows it to infiltrate the gravel bed and clog the drainage space. In addition, this gravel often works its way to the top and eventually is moved onto the green site that the bunker guards when an explosion shot is hit. This in turn causes damage to mowing equipment when used to cut the greens.

In the construction of golf courses, one of the most important items is the location and the construction of bunkers or traps which are positioned at strategic points along fairways, in order to present a greater challenge for a golfer during the golf game. At the present time, a trap is constructed in such a manner which would basically include the hollowing out in a type of saucer shape of a portion of ground, digging a series of trenches below the surface of the ground for incorporating a series of drainage lines for water being drained through the sand of the traps. When it is desirable to eliminate contact between the sand and the native soil, there would be positioned a layer of fluid permeable fabric such as geo-textile fabric along the floor of the trap to the very edges of the saucer shape foundation, and then there would be laid upon that a layer of sand which would serve as the trap media. The problems which are confronted with this standard construction of traps are several. One of the problems derives as a result of the flow of water into the bunker from the surrounding fairway so that as the water flows into the bunker it would essentially follow the slope of the "saucer" foundation, and from the peripheral edge of the bunker, down towards the lower portion of the trap, in the process the sand is eroded off of the top edge of the bunker, wherein there appears to be exposed a ridge of soil around the peripheral edge of the bunker, which would require hand labor to refurbish the sand in the trap in order to eliminate the erosion problem. Furthermore, as the sand is displaced from the edge of the trap, this would tend to expose geo-textile fabric laid to the peripheral edge of the saucer hollow, and during the "combing" of the sand in order to maintain the visual quality of the traps, exposed fabric may get snagged by the comb, and be pulled out of place, which would result in a very unsightly trap and a difficult problem to redistribute the fabric properly along the base of the trap.

These problems, as outlined, are addressed by the present invention, and the system of the present invention would tend to solve these problems as will be expressed following.

SUMMARY OF THE PRESENT INVENTION

The system of the present invention solves the problems in the art in a simple and straightforward manner. What is presented is a system for constructing golf course traps which would include the steps of forming a cutout area in the fairway in the desired shape of the trap, the cutout area including a continuous substantially vertical sidewall and a substantially flat floor portion; forming a plurality of channels for housing a composite drainage line, which would normally comprise a waffle like plastic material shrouded in a geo-textile material for allowing water to flow internally of the material and travel along the waffle like internal structure. This composite drainage line, hereinafter referred to as "TURF DRAIN" undertakes drainage of the traps. Prior to the placement of the turf drain lines within the channels, placing a continuous sheet of an impermeable plastic liner at least along the floor of the the trap and the continuous sheet forming within the plurality of channels; positioning the "turf drain" composite drainage line within the channels so that the plastic liner is positioned between the soil and the turf drainage line; and filling the trap with sufficient sand for allowing the upper most portion of the sand within the trap to be formed as would a normal sand trap, that is slightly concave, so that as water drains into the trap, the water would essentially follow the vertical wall of the trap, and would drain along the plastic liner, and to the turf drain lines to be drained from the trap, without the water ever making contact with the soil beneath the plastic liner or turf drain line. The sidewalls of the bunker are not cut at a gentle slope. They are cut straight down. The main purpose of this technique is to reduce the velocity of the water as it travels the distance along the base grade. The water travels straight down to the bunker floor which is slightly sloped towards the drain tile in the middle of the bunker. The objective is to slow down the velocity of the water when it starts to move laterally towards the drain tile.

In the past, when liners are used, they have all been of the permeable nature which allowed the movement of the water through the fabric to the drain tile that has traditionally been placed below the fabric liner. In this design, the liner need not be permeable because of the uniqueness of placing the drain tile above the liner. Also, the fabric liner was even more prone to be snagged by the "sand pro" since the edges ran up the base grade to the top point of the trap. This exposed the edge of the fabric to an area where sand could become very thin. The edge of the liner is positioned beneath the deepest area of sand. The trenches that have been dug for the placement of the drain tile that will take place are dug deep enough so that the top of the drain is no higher than the base grade of the bunker, thus not protruding into the playing surface of the sand. This plastic liner then is contoured to fit down into the bottom of the trench that is to contain the drain tile. The plastic with the least amount of stretch is used so that if the "sand pro" should ever catch a part of the plastic, it won't snag on the "sand pro" and stretch it out of place. The edges are then anchored in a trough that is built at the bottom of the sidewall on the bunker floor. It has not been necessary to build this trough completely around the bunker, but only in the higher areas of the bunker so as to eliminate water running under the plastic. Thirdly, the drain tile is placed in the drainage trench. It is placed above the plastic and only the sand is used in the trench; there is no gravel at all used in this design. The drain tile that is most suited for this purpose is the waffle type structures because they have the largest amount of area for the drainage water to enter the drain system when compared to a 4 inch perforated pipe. However, the 4 inch perforated pipe wrapped in a sock could be substituted in this design.

Due to the fact that some bunkers will be constructed on slopping areas, so that a substantially flat floor cannot be accommodated, it would be desirable to reduce the slickness of the plastic layer. This may be accomplished through the use of a solvent glue or adhesive of some type applied to the upper surface of the plastic that will hold the layer of sand that is placed upon it. This initial layer of sand, coming into contact with the solvent glue will serve to increase the friction between the plastic layer liner and the sand within the trap, so that movement of the sand is reduced or eliminated due to the slopeing nature of the bottom of the bunker.

Therefore, it is a principal object of the present invention to provide an improved trap or bunker for golf courses, which facilitates proper drainage of the trap during use;

It is a further object of the present invention to provide an improved trap in a golf course, utilizing the turf drain composite drains for receiving water draining from the sand in the trap, yet prior to the water making contact with the soil beneath the turf drain lines;

It is a further object of the present invention to provide an improved sand trap having substantially vertical walls, a plastic liner on the bottom of the floor of the trap, a plurality of turf drain lines positioned above the plastic liner and the soil beneath the plastic liner so that water draining;

It is a further object of the present invention to provide an improved sand trap which allows water draining from the fairway into the trap to follow the vertical wall of the trap, and therefore, prevent sand from flowing toward the center of the trap and causing erosion around the peripheral edge of the trap;

It is still a further object of the present invention to provide an improved sand trap on a golf course which prevents the movement of sand from the edge of the trap and thus prevents exposure of any liner beneath the layer of sand in the trap;

It is therefore an object of the present invention to provide a system that will help to reduce the amount of washing that occurs on the faces of the bunker through the use of a sidewall dug straight down to the bunker floor;

It is also an object of the present invention to provide a liner that will not be snagged by the use of routine maintenance equipment. This is best done by the use of an impermeable plastic with a small amount of stretch, and the placement of that liner so that the edges are at a point where the sand is the deepest;

It is also an object of the present invention to provide a design which provides all of the drainage above the liner that is used, and to place the edges of the liner in a spot in the bunker where the sand is the deepest;

Also it is an object of the present invention to create a design that eliminates the use of gravel;

It is also an object of the present invention to provide a way through the use of a solvent that can create a surface more resistant to erosion when the bunker depth will require it; and It is the object of the present invention to provide a design that can be used in the draining of coal piles.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
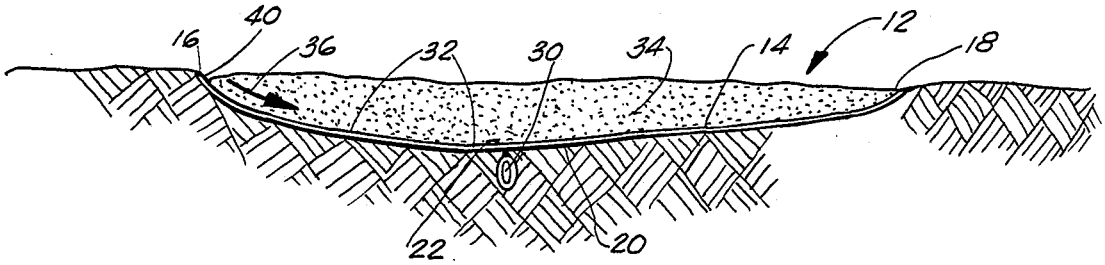
FIG. 1 PRIOR ART
FIG. 1 illustrates a cross sectional view of a standard state-of-the-art golf course sand trap and drainage system.

FIG. 1 illustrates the present state of the art in sand trap construction. As seen in the Figure, there is illustrated a sand trap 12 which is formed from a hollowed out portion of fairway 14, hollowed out in the shape of a saucer, extending from a first edge 16 to a second edge 18, as seen in cross-sectional view, in FIG. 1. The sand trap may be configured in any desired shape overall, to suit the needs of the builder, but in most cases would include a sloping floor portion 20, sloping from the edges 16 and 18 of the trap, down to a central portion 22, to form the "saucer shape" of the trap. On the floor portion 20 of the trap, there would be included a plurality of drainage trenches 30, for housing a drainage line such as PVC pipe or the like, the pipe having a standard drainage means such as a plurality of holes for receiving water and carrying the water from the floor of the trap to a remote water drainage source. As seen in the Figure, there is further provided a layer of geo-textile material 32 which, for the most part, is a fluid permeable material for allowing the water draining down through the sand of the trap, would drain through the material and into the drainage line 30. The geo-textile fabric layer 32 would extend, again, along the entire floor portion of the trap, to the very edges 16 and 18 as seen in FIG. 1. Following the placement of the geo-textile fabric along the floor portion, the trap would then be filled with sand 34, and the result being a finished trap for use on a golf course. As was stated earlier, such a trap presents the problem of the displacement of sand along the edge of the trap as water drains along the arcuate floor portion 20 of the trap as seen in the direction of Arrow 36, wherein the displacement of sand forms a ridge of soil 40 as seen in FIG. 1, which is unsightly, and is an unwanted feature in a sand trap. However, due to the flow of water along the slope floor of the trap, is a feature is a result of the present construction of traps.

Figure 2:
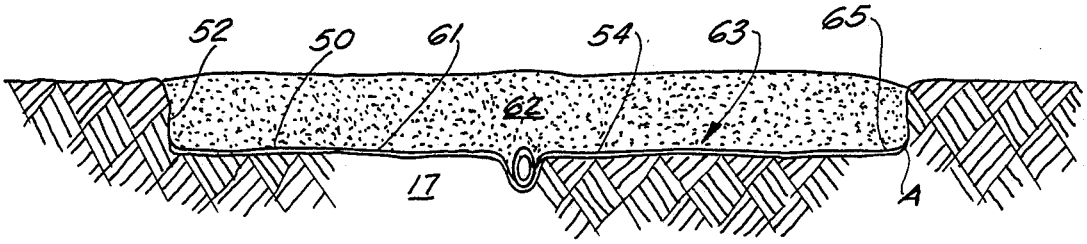
FIG. 2 illustrates a cross sectional view of the improved sand trap of the present invention.
Figure 3:
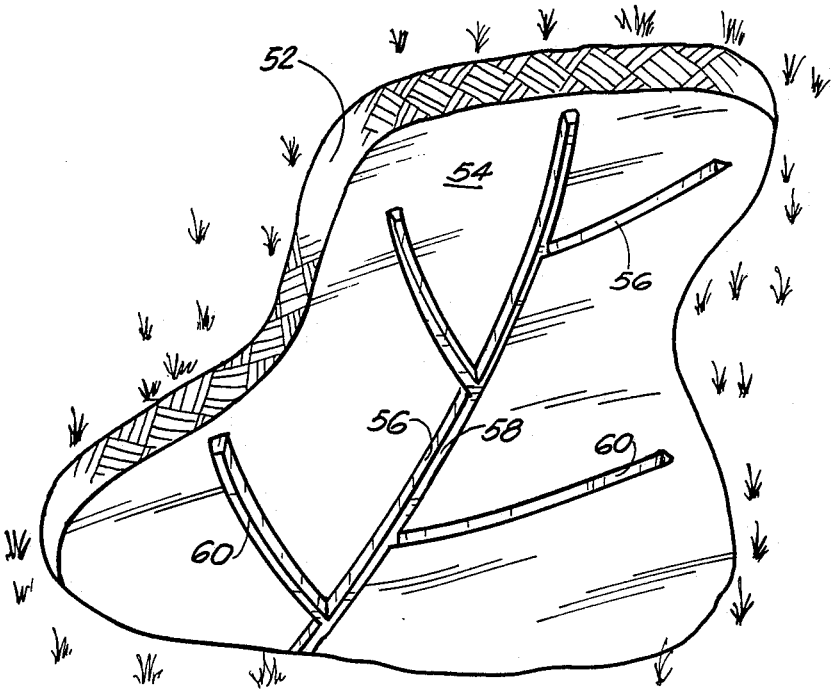
FIG. 3 illustrates an overall composite view of a sand trap dug out of the soil of the fairway prior to the introduction of sand thereinto.
Figure 4:
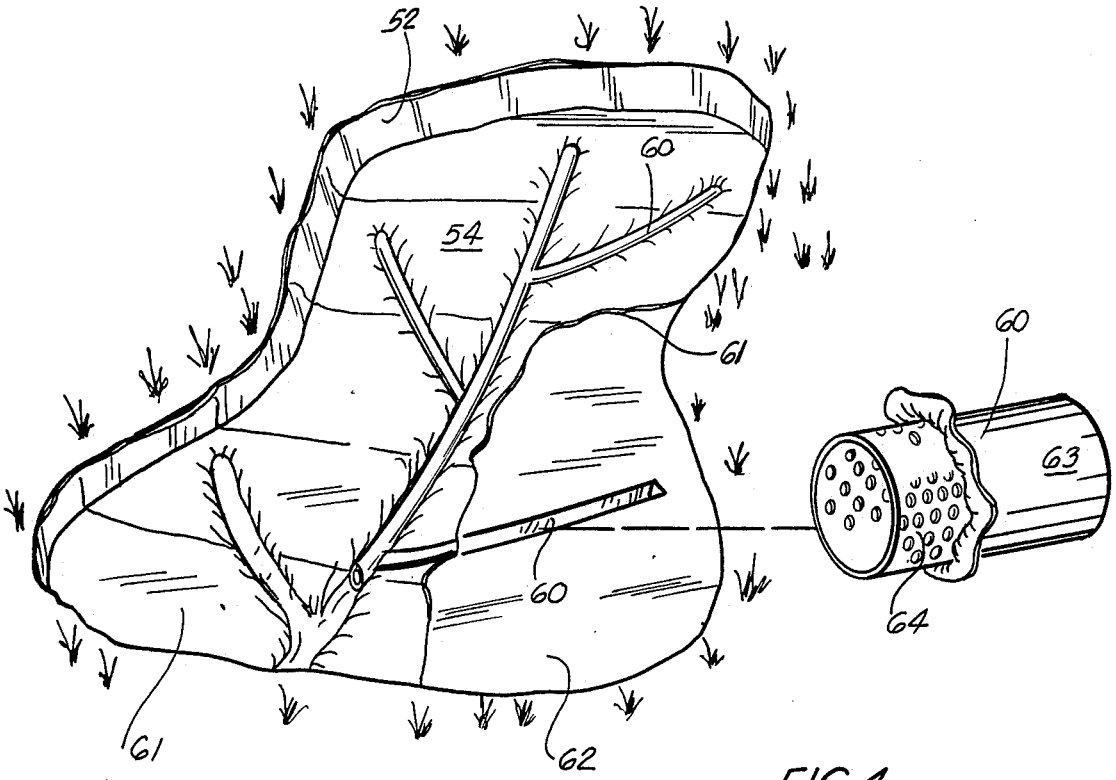
FIG. 4 illustrates the overall system of the present invention prior to placement of sand in the prepared space.
Figure 5:
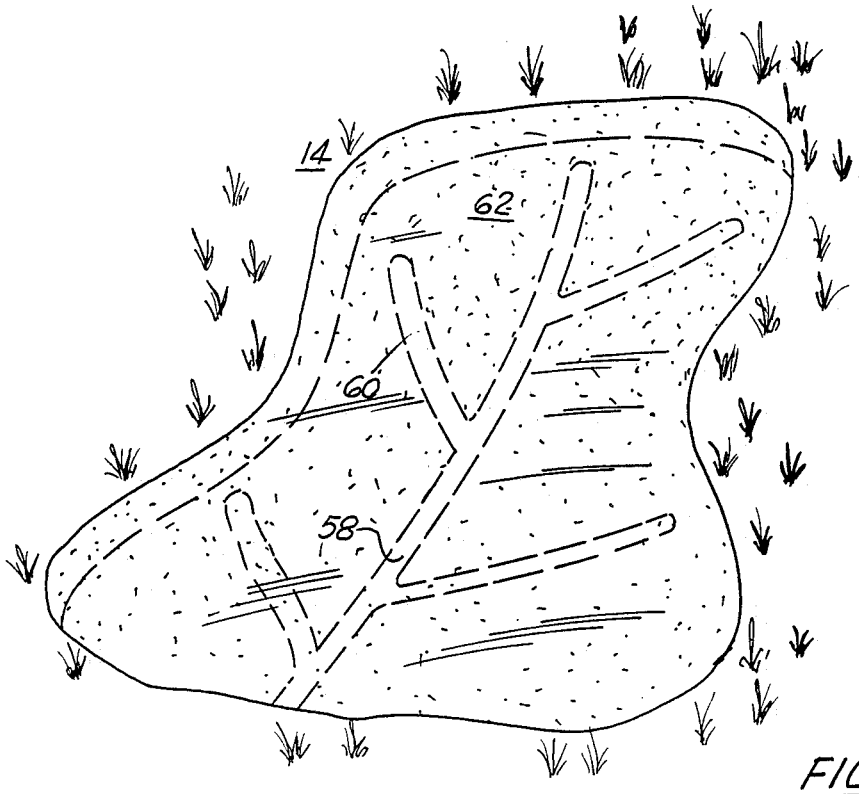
FIG. 5 illustrates the completed sand trap of the present invention.

Turning now to the present invention, reference is made to FIGS. 2 and 3. As seen in the Figures, there would be provided again a dug-out portion of the soil within the fairway 14, to a requisite depth of between 12 and 18 inches. As seen in FIG. 2, the hollow 50 would include a continuous substantially vertical side wall 52, forming the wall of the hollow, and a floor portion 54, having a flat soil base, for defining the floor portion of the hollow as seen in the Figure. As seen in FIG. 3, following the formation of the trap in the desired configuration, with vertical side walls 52 and substantially the flat floor portion 54, there would then be dug a plurality of drainage ditches 56 in the floor 54 of the trap, for accommodating a drainage line, preferably the composite drainage line known as turf drain, which is a composite drainage line formed of an internal plastic waffle material, enshrouded in a geo-textile fabric for allowing water flow into the space between the fabric and the liner, and water flow along the plastic waffle lining to a drainage source. As is illustrated in the Figure, there would be formed a principal drainage line 58, extending substantially through the length of the floor 54 of the trap, with a series of secondary lines 60, stemming off from principal line 58, each of the principal lines 58 and branch lines 60 are dug out for housing the composite turf drain line throughout its length. Following the digging of the various lines 58 and 60, and prior to the placement of the turf drain within the drainage ditches, there would be placed a layer of impermeable plastic material, such as plastic liner 61, along the floor 54 of the hollow, with the plastic 61 liner forming a continuous layer of protective barrier between the soil 17, of the floor portion 54, and the sand 62 that will be placed into the hollow. As illustrated, the layer of plastic liner would be continuous along the floor portion and would extend down into each of the drainage ditches 58 and 60 to form the continuous barrier 63 along the floor portion. The plastic liner could be enclosed down to the soil at corners 65. In the preferred embodiment, plastic liner 61 would not extend along the vertical walls 52, but would terminate at that point of juncture between the vertical wall 52 and the floor portion 54. Following the placement of the plastic liner, the various lengths of turf drain lines 50 and 60 would be inserted into the drainage lines, with the branch lines being interconnected to the main line 58 via the connection sleeve as disclosed in U.S. Pat. No. 4,756,643.

Again, it should be understood, that the plastic liner 61 is positioned between the turf drain lines 58 and 60 and the soil 17 of the various drainage ditches that are formed in the bottom of the hollow.

As was stated earlier, in some instances it may be required that the bunker be constructed in an area where it would be impracticable to construct a bunker floor have a zero grade. In instances where the bunker floor would have, for example, a greater than 5 to 7 degree grade, if sand would be placed on the slick plastic liner, there is the possibility that the sand may slowly shift due to the grade of the floor, and erosion or movement of the sand would occur. Therefore, in order to eliminate this possibility, one would include the additional step of coating the upper surface of the impermeable plastic liner with a solvent glue. Following that, a layer of sand would then be sprinkled along the entire bottom of the bunker, so that the sand would adhere to the glue, and the result would be a grade surface having much greater friction. Therefore, on placement of the sand in the bunker, the sand would be less likely to move and would more likely remain in position within the bunker.

Therefore, a quantity of sand 62 is poured into the hollow, to form the bunker, as illustrated in FIG. 2. Therefore, any water flowing through the layer of sand 62 will flow through the sand, make contact with the plastic liner 61, and would flow into the various drainage lines to be received by the turf drain composite drainage line providing flow out of the bunker. Likewise, any water flowing from the surrounding fairway soil 14, would flow down the vertical walls 52 of the hollow, and would flow along the face of the plastic liner 61 next to the sand layer 62, and into the turf drain line drainage system. The result would be that no water flowing into the bunker would make contact with the soil beneath the sand, and therefore the plastic liner 61 would eliminate any possibility of the soil being brought up to mingle with the sand, and yet at the same time due to the vertical walls of the bunker, and the vertical drainage of the water from the surrounding soil of the bunker, the water would not tend to carry sand from the peripheral edge of the bunker which would normally result in the formation of the soil ledge around the bunker, which is a problem as stated earlier in the present state of the art.

Figure 6:
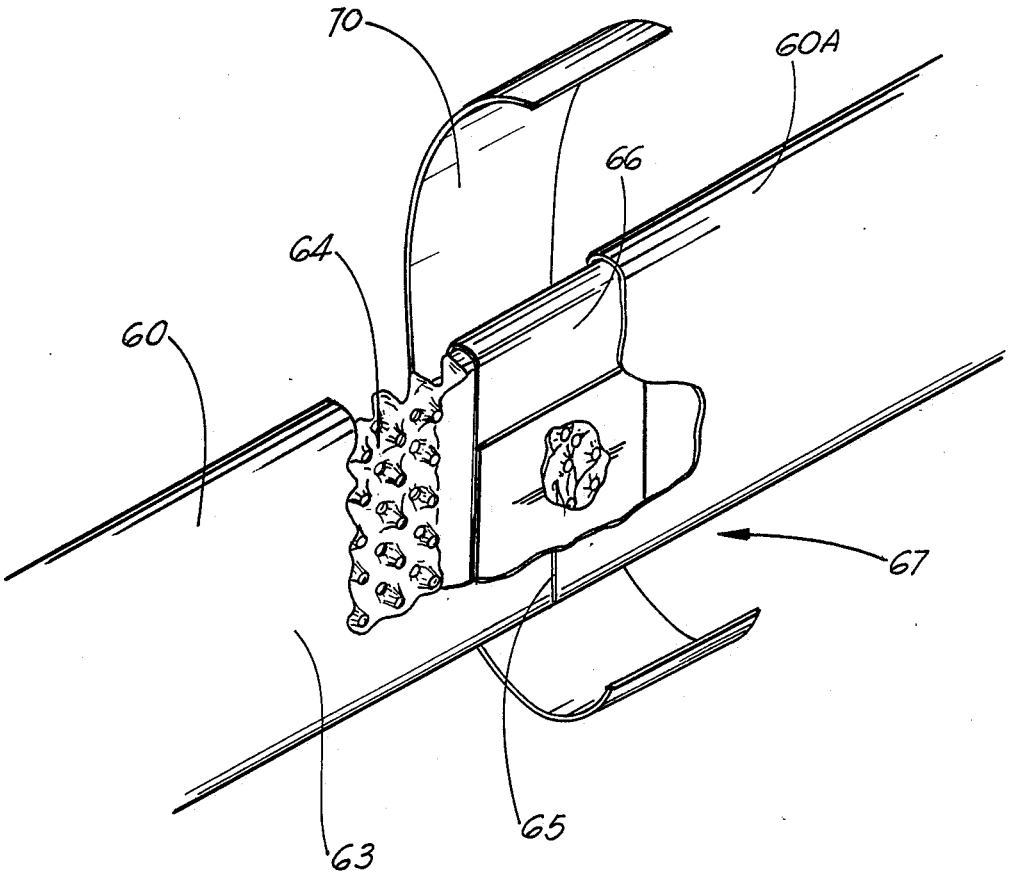
FIG. 6 is an overall view of a system for connecting the underground turf drain lines in the system of the present invention.

FIG. 6 illustrates in overall view a system for connecting, end-to-end, portions of the drain lines which serve to drain the water flow from the floor, for example, of the improved bunker system of the present invention. What is provided is a first portion of drain line 60, and a second portion of drain lines 60A, the portions of drain line 60, 60A interconnecting end-to-end to form a continuous and composite drain line 67. Each drain line 60 and 60A are provided with an internal draining member 64, which is a molded plastic, typically used in drainage systems, for allowing water flow between the raised portions of the plastic. There is further provided an external geo-fabric membrane 63, which surrounds each portion of the plastic so that flow of water is allowed into the geo-fabric membrane, and once into the flow cavity, between the membrane and the plastic, produces water flow within the drain line. As illustrated, when the sections of lines 60 and 60A must abut end-to-end at point 65, there is a possibility of having a loss of fluid flow between the abutting lines. Therefore, there is provided a second internal plastic sleeve 66, which is positioned intermediate the internal plastic member 64 and the external geo-fabric layer 63, so that the plastic sleeve 66 overlaps a slight distance over each of the members of the plastic, so that as water flows across the abutting drain line 60 and 60A, the flow is contained within the plastic sleeve 66, and the plastic sleeve 66 would prevent any loss of water where the internal plastic members abut end- to-end, and requires a significant reduction in time and labor in the construction of the continuous line. At the juncture of the plastic sleeve 60, as is illustrated, in geo-fabric material also abuts end-to-end and is provided with a sealant such as a plastic tape 70 around the ends of the geo-fabric layer 63, to provide a continuous material layer throughout the drainage line, particularly at the portion of the line that the lines are interconnected. Of course, although the system of providing a system for allowing end-to-end abutting of drain lines in order to form a continuous line is illustrated with the use of the improved bunker design, this type of turf drain system could be utilized in any time of under-type drainage of golf courses and the like.

Figure 7:
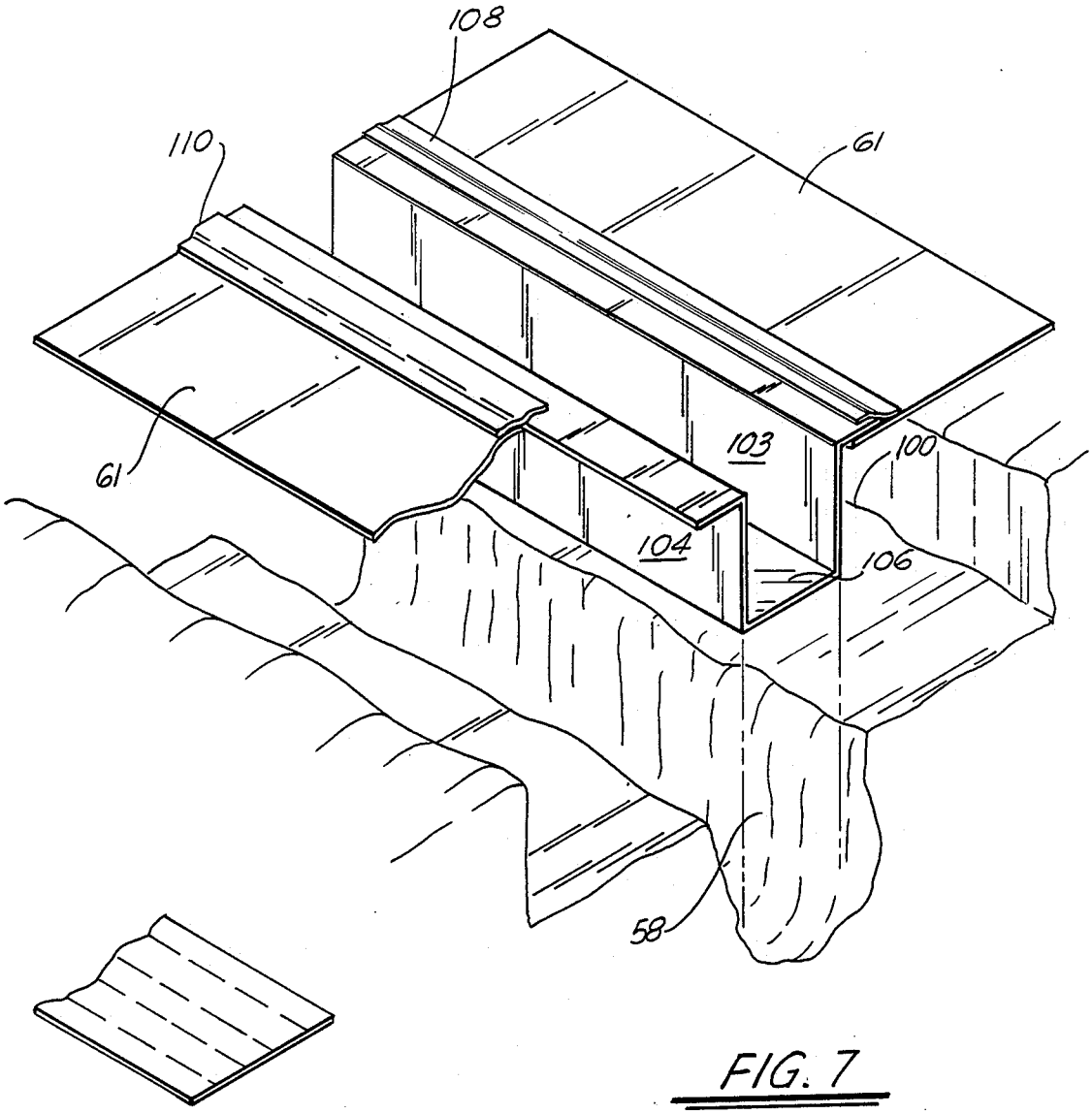
FIGS. 7 and 8 are exploded and cross-sectional view of an additional alternate embodiment of the system of the present invention.
Figure 8:
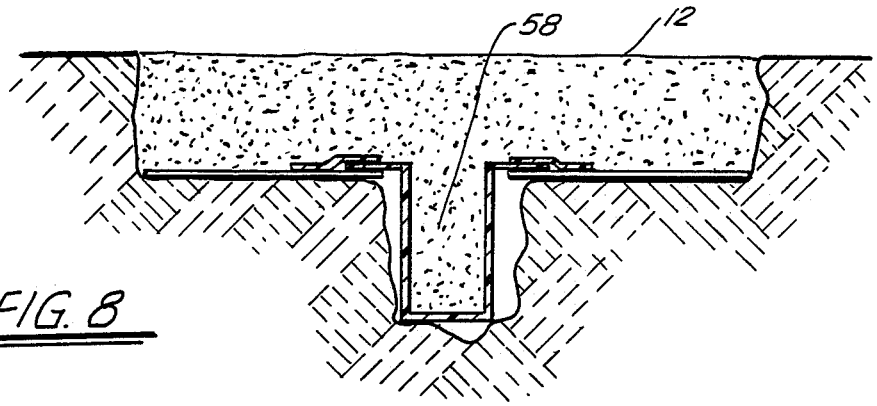

Although FIG. 2 of the principal embodiment illustrates that the plastic liner 61 would be manually formed within lines 58 and 60, and upon which the drainage line is set, FIGS. 7 and 8 illustrate an additional means by which the plastic liner 61 may be formed to properly set within drainage lines 58 and 60 in the principal embodiment. As is illustrated, plastic liner 61 would include a substantially U-shaped portion 100, having a pair of side walls 102 and 104, and a floor portion 106, formed as a continuation of liner 61, so that as illustrated in FIG. 8, rather than having to manually form the liner into the cavity formed by the trenches, the U-shaped portion 100 would fit within the trenches, thus eliminating the need for manually forming the layers 61 into the trench. As illustrated, a U-shaped portion 100 may be attachable along edge 108 and 110 to each of the portions of plastic sheet 61, after being placed within the trench 58 or 60, so as to form a continuous liner 61 within the bottom bunker 12 as illustrated in FIG. 8. This manner of forming the liner along the floor portion of bunker 12 and into the trench, would facilitate the placement of the liner into the trench rather than to manually form it as it is done in the principal embodiment.

Figure 9:
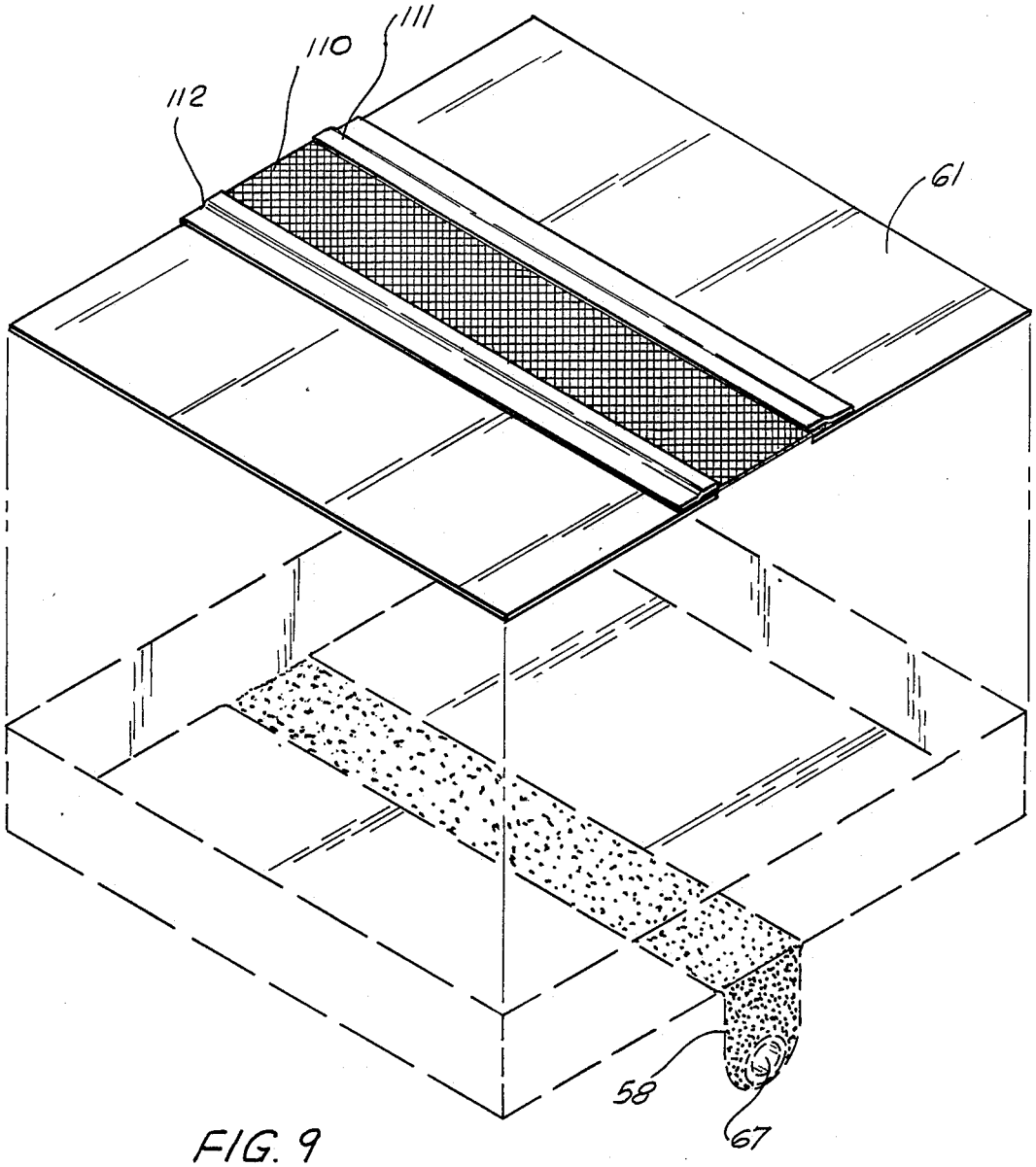
FIG. 9 is an overall view of an alternate embodiment of the system of the present invention.
Figure 10:
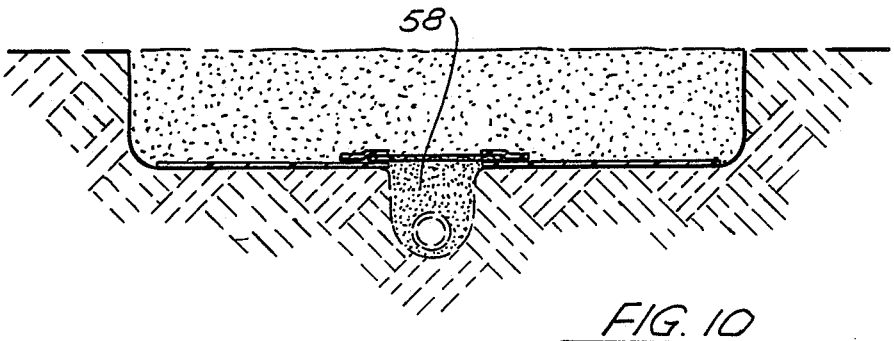
FIG. 10 is a cross-sectional view of an alternate embodiment of the system of the present invention.

FIGS. 9 and 10 illustrate an embodiment of the apparatus of the system of the present invention, which may be utilized when the bunker 12 is being re-worked, but already has the composite drainage line 67 in place, for draining off water in the bunker. Therefore, rather than have to pull line 67 up, in order to place the liner 61 to conform to the shape of a trench 58 or 60, there would be provided a liner 61 again, formed along the floor portion of the bunker, as illustrated in FIGS. 9 and 10. However, at the point that the liner would be overlying the trench, there would be incorporated a length of geo-textile fabric 110, which is a water permeable material, but withstands the flow of solids therethrough.

Therefore, as illustrated in FIGS. 9 and 10, that portion of the liner 61 that would overlap the trenches 58 or 60 along the floor portion of the bunker would be covered with the geo-textile fabric 110 attached at its edges 111 and 112 to the section of liner 61, so that as water flows into the sand trap along the liner 61 it would flow through the geo-textile fabric 110 into the trench 30 and into line 67 for flow out of it. This type of embodiment would be utilized primarily with bunkers that are already in place, and would remove the need to retrench each of the bunkers, in order to put the formed liner in place.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A system for constructing an improved sand trap for a gold course, comprising the following steps:

(a) digging out a hollow in the soil in a desired shape, the hollow including a continuous side wall around its peripheral edge, and a substantially horizontal floor portion;

(b) forming a drainage ditch in the floor portion of the hollow;

(c) positioning a layer of water impermeable material at least along the entire floor portion of the hollow, including extending into a drainage line dug in the floor portion of the hollow;

(d) placing a composite drainage line within the drainage ditch and resting upon the upper surface of the water impermeable material; and (e) adhering a quantity of sand onto the layer of water impermeable material at least along the entire floor portion of the hollow and placing additional sand to a depth at least to an upper edge of the continuous wall, for defining the upper surface of the sand trap; and (f) draining water from the sand in the sand trap substantially along all points of the composite drainage line.

2. The system in claim 1, wherein the continuous wall would be a substantially vertical side wall meeting the horizontal floor portion in substantially a 90 ° angle.

3. The system in claim 1, wherein the vertical side wall further defines a vertical drainage line for flow of water between the surrounding soil and the trap.

4. The system in claim 1, wherein the water impermeable material further comprises a plastic sheet.

5. The system in claim 1, wherein the water impermeable material further defines a means for preventing water flowing into the sand trap from making contact with the soil on the floor of the hollow.

6. The system in claim 1, wherein there may be further provided U-shaped portion of the impermeable material for positioning within the drainage ditch and the floor portion of the hollow.

7. An improved sand trap, comprising:

(a) a trap hollow, formed into the soil, defined by a continuous vertical side wall, and a substantially horizontally floor portion;

(b) an impermeable material laid at least across the entire floor portion of the hollow;

(c) a composite drainage line ditch formed of a rigid internal flow member, covered by a geotextile fabric, for allowing water to flow into the drain line at substantially all points along the drainage line, the drainage line positioned upon the layer of impermeable material, out of contact with the floor portion of the hollow; and (d)sand adhered against the impermeable material laid at least across the entire floor portion of the hollow and additional sand placed to a depth so that the upper face of the sand is substantially the depth of the vertical wall of the hollow.

8. The improved sand trap in claim 7, wherein there may be further included the step of forming a drainage ditch along the bottom formed within the floor portion of the hollow, and placing the drainage line into the floor of the hollow following step (a).

9. The improved sand trap in claim 7, wherein the drainage line would be resting on the upper surface of the impermeable material laid across the entire floor portion of the hollow.

10. The improved sand trap in claim 7, further comprising a connector between abutting drainage lines, including a plastic sleeve positioned between an internal flow member and geo-textile fabric and enveloping the ends of the flow member so as to provide continuous water flow between the abutting lines.

11. A method of constructing a sand trap or bunker of a gold course, comprising the following steps:

(a) forming a hollow in the soil in a desired shape, the hollow including a substantially continuous vertical sidewall, and a substantially horizontal floor portion;

(b) forming a drainage ditch in the floor portion of the hollow;

(c) positioning a layer of water impermeable material at least along the floor portion of the hollow, the water impermeable material extending into the drainage ditch dug in the floor portion of the hollow;

(d) next, gluing a layer of sand tot he upper surface of the impermeable material when the floor portion of the hollow is at a grade of at least 5°;

(e) pouring a quantity of sand into the hollow to at least the upper edge of the continuous vertical sidewall, the layer of quantity of sand defining the upper surface of the sand trap.

12. The method in claim 11 wherein the water impermeable material provides a means for preventing moisture moving along the vertical side wall of the hollow or through the sand in the hollow from making contact with the soil beneath the water impermeable material.

13. The method in claim 11, wherein step (c) would further include the step of enveloping a rigid core member with geo-textile fabric formed along the liner, and that point overlapping the drainage ditch in the floor portion of the hollow for allowing fluid to flow through the geo-textile fabric into the ditch.

* * * * *